US006145165A

United States Patent [19]

Torcato

[11] Patent Number: 6,145,165

[45] Date of Patent: Nov. 14, 2000

[54] HINGE MECHANISM

[75] Inventor: Joseph Torcato, New Market, Canada

[73] Assignee: Alwind Industries, Ltd., Canada

[21] Appl. No.: 09/170,108

[22] Filed: Oct. 13, 1998

[51] Int. Cl.[7] ..... E05C 9/00

[52] U.S. Cl. ..... 16/355; 16/267; 16/225; 16/DIG. 13; 49/397

[58] Field of Search ..... 16/266, 267, 362, 16/374, 225, 380, 268, DIG. 13, 355, 269; 49/161, 382, 397, 399, 400–402

[56] References Cited

U.S. PATENT DOCUMENTS

| | | | |
|---|---|---|---|
| 731,138 | 6/1903 | Stearns | 16/355 |
| 1,734,810 | 11/1929 | Jeffers | 16/269 |
| 2,205,015 | 6/1940 | Lowry et al. | 49/397 |
| 2,302,661 | 11/1942 | Benson | 16/267 |
| 2,662,766 | 12/1953 | Burress . | |
| 2,762,475 | 9/1956 | Bowden | 49/397 |
| 2,797,778 | 7/1957 | Wagner . | |
| 2,845,665 | 8/1958 | Place | 49/397 |
| 3,210,808 | 10/1965 | Creager | 16/225 |
| 3,331,161 | 7/1967 | Ruff | 49/397 |
| 3,473,266 | 10/1969 | Miller . | |
| 3,718,943 | 3/1973 | Bustin | 16/355 |
| 3,802,127 | 4/1974 | Silvernail . | |
| 3,908,313 | 9/1975 | Bierlich . | |
| 4,084,361 | 4/1978 | Aspaas . | |
| 4,175,357 | 11/1979 | Goldhaber . | |
| 4,315,345 | 2/1982 | Schijf | 16/267 |
| 4,438,993 | 3/1984 | Rabas . | |
| 4,562,668 | 1/1986 | Karhu et al. . | |
| 4,578,905 | 4/1986 | Hout . | |
| 4,942,271 | 7/1990 | Corsi et al. | 16/267 |
| 5,048,715 | 9/1991 | Wolff | 16/267 |
| 5,123,129 | 6/1992 | Lyons | 16/DIG. 13 |

FOREIGN PATENT DOCUMENTS

| | | | |
|---|---|---|---|
| 721064 | 11/1965 | Canada | 49/397 |
| 705196 | 6/1931 | France | 16/269 |
| 2935967 | 4/1981 | Germany | 16/355 |
| 63-149406 | 6/1988 | Japan | 16/355 |

*Primary Examiner*—Anthony Knight
*Assistant Examiner*—Mark Williams
*Attorney, Agent, or Firm*—Parkhurst & Wendell, L.L.P.

[57] ABSTRACT

A hinge mechanism is disclosed which allows for pivotal attachment of a moveable member to a fixed frame member defining a linear edge of an opening. Such pivotal attachment allows for movement of the moveable member relative to the fixed frame member between a closed position, in which the moveable member is positioned substantially within the opening, and an open position, about a pivot axis aligned parallel and adjacent to the linear edge and positioned in offstanding spaced relation thereto. The hinge mechanism comprises a fixed hinge component and a moveable hinge component. The fixed hinge component comprises a base portion, mountable upon the fixed frame member, a longitudinally extending pin portion and a support arm extending between the portions in connecting relation. The pin portion has a substantially cylindrical outer surface and is terminally positioned on the support arm, a portion of the outer surface defining a first bearing surface. The moveable hinge component has a swinging portion, adapted for attachment to the moveable member, and a pivoting portion, having a concave inner second bearing surface concentric with the first bearing surface and being operatively mounted about the first bearing surface so as to provide for the pivotal movement. A first longitudinally extending shoulder projecting from the moveable hinge component and a second longitudinally extending shoulder projecting from the fixed hinge component, are arranged such that, upon the moveable hinge component pivoting to the open position, the first shoulder impinges upon the second shoulder to arrest further opening rotation.

11 Claims, 7 Drawing Sheets

HINGE MECHANISM

FIELD OF THE INVENTION

The present invention relates to the field of window frame and sash construction, and more particularly to a hinge mechanism of the continuous pin and socket type, intended for use in combination with window frames and sashes.

BACKGROUND OF THE INVENTION

It is desirable in modern construction practice that operable windows be installed in buildings, which windows are weatherproof, durable in operation, aesthetically pleasing and economical in terms of the production, installation and maintenance cost of same.

It is common in the prior art for windows, particularly institutional or commercial windows, to consist of a fixed frame and a swinging sash, with the frame and sash being constructed in part from components of extruded metal, such as aluminum, for reasons of strength and economy.

It is also known in the prior art for continuous hinge mechanisms of the pin and socket type to be utilized, for strength and esthetic reasons.

Further, it is known in the prior art for the pin and socket of such a continuous hinge to be incorporated as part of a window assembly. Examples of such prior art, with the pin incorporated into the sash and the socket incorporated into the frame, are shown in U.S. Pat. No. 2,845,665 (Place), issued Apr. 2, 1956, U.S. Pat. No. 3,908,313 (Bierlich), issued Sep. 30, 1975, and U.S. Pat. No. 4,175,357 (Goldhaber), issued Nov. 27, 1979.

However, known prior art window assemblies having hinge mechanisms of the continuous pin and socket type are known to fail as a result of the stresses created upon the hinge mechanism. Moreover, such known prior art window assemblies suffer, inter alia, from unduly high production, installation and maintenance costs, undue complexity of assembly, ranges of free rotation unsuitable for normal use, and undue weight and bulk.

In prior art window assemblies of this type, when the swinging sash has pivoted to the limit of its free rotation about the pin, the application of additional force typically results in stresses being placed upon the hinge socket. Such stresses can result in inelastic distortion of the components of the hinge, and the creation of clearance between the pin and socket, with adverse effect upon the operation of the mechanism; for example, looseness in the hinge mechanism, which enables the window to rattle in its frame. As well, failure of the weatherproofing can result.

In addition, forces are typically created in prior art hinge of this general type in a direction oriented to displace the pin from the socket. As a result, where the shape of the socket has become distorted as mentioned, the pin can actually breach the socket, allowing the swinging sash to become operatively disconnected from the frame.

The risk of the swinging sash becoming disconnected can be lessened by decreasing the width of the aperture in the socket, since, all other things being equal, the amount of force required to displace the pin from the socket is thereby increased; however, this solution to the problem has a corresponding negative impact upon the free range of rotation of the sash, and is not favoured.

Similarly, the substitution of another material as the socket substrate, which material is also resistant to corrosion but stronger than aluminum, can also increase the amount of force required to displace the pin from the socket; known alternative materials, however, such as stainless steel, are uneconomic, both in terms of the raw material cost and the costs related to manufacture, as aluminum is particularly well-suited to processing through the low cost extrusion process.

Therefore, the aforementioned problems are typically overcome in the prior art by one or more of the following methodologies: (a) increasing the thickness of the socket material to increase rigidity, such that additional force is required to be exerted before the socket distorts; and, (b) constructing suitably robust external means to arrest the swinging sash in its rotation before it reaches the limit of its free range of motion.

While either of these solutions may resolve to some extent the problems associated with prior art hinges of the general type under consideration, each of these solutions necessarily cause the cost of production and installation of the window and sash assembly to increase. Moreover, in some cases, these solutions increase the bulk and weight of the window assembly to unacceptable levels, or are aesthetically unpleasing.

Similar problems exist in prior art windows when the pin is incorporated into the frame and the socket into the swinging sash. U.S. Pat. No. 4,084,361 (Aspaas), issued Apr. 18, 1978, shows a window assembly of this type intended for pivotal opening about a vertical axis. In addition to the problem of the stresses placed upon the hinge mechanism, this design also suffers from the requirement that suitable weatherstripping be incorporated about the hinge mechanism to avoid infiltration of moisture and debris, the weatherstripping being in an area exposed to weather. The need for weatherstripping adds to the cost of production of the window assembly, and the location of the weatherstripping in the design results in further costs due to required maintenance.

U.S. Pat. No. 2,797,778 (Wagner), issued Jul. 2, 1957, is an example of the prior art which attempts to resolve the problem of the aforementioned stresses which can be created when the sash has pivoted to the limit of its rotation by employing co-operating spiral flanges to form the hinge mechanism. In this design, the limit of rotation is almost a full 360°, well outside the range of motion required for normal window installations. The Wagner design, however, suffers from an inherent drawback in that, as the radius of a spiral increases (or decreases) gradually throughout its length, there can be no free range of motion in a hinge mechanism incorporating co-operating spiral components. At any given point of contact between the spiral components, rotation of one spiral with respect to the other brings into contact points of different radius, thereby causing one or both of the spirals to expand or contract at the point of contact. Depending upon the torsional rigidity of the construction medium of the spiral flanges and the nature of their construction, this can result in the need to apply significant force to effect rotation. This problem is exacerbated by the additional surface area such a spiral hinge exposes to friction, further increasing the force required to effect rotation. The problem of high rotational force can be resolved, in part, by the incorporation of lubricating material, such as tetrafluorethylene, between the co-operating flanges, which material adds to the cost of construction, or alternatively, the provision of clearance, which results in a hinge without controlled smooth operation.

U.S. Pat. No. 3,802,127 (Silvernail), issued Apr. 9, 1974, illustrates a further attempt in the prior art to overcome the subject stresses. In the Silvernail patent, a bead positioned on the smaller arm of an inverted J-shaped member pivots in a groove and provides the pivoting mechanism for the window. This design resolves the issues of the subject stresses to a limited extent, as, at the limit of rotation, the application of additional opening force on the window sash will not tend to distort the socket. In this design, however, the bead portion will still become subject to stresses tending to unseat it from the groove. Moreover, the Silvernail patent requires weatherstripping at two locations within the hinge mechanism and requires an external flash guard/drip rail to protect the mechanism from water and debris infiltration. Further, the Silvernail device requires a separate bulky plastic component wherein the groove is located. All of these factors add to the cost of production and maintenance of the Silvernail assembly.

SUMMARY OF THE INVENTION

It is an object of the present invention to overcome, inter alia, the shortcomings of the prior art described above by providing a hinge mechanism that is durable, has free rotation through a range of rotation that is suitable for normal installations, that is economical to produce, install and maintain, that is weatherproof and aesthetically pleasing, that is not susceptible to the problem of the sash becoming dislodged from the fixed frame, and which is not unduly heavy or bulky.

These and other objects are addressed by the present invention, a hinge mechanism which provides for pivotal attachment of a moveable member to a fixed frame member, with the fixed frame member defining a linear edge of an opening. Such pivotal attachment allows for movement of the moveable member relative to the fixed frame member between an open position and a closed position about a pivot axis, which pivot axis is aligned parallel to and adjacent to the linear edge and is positioned in offstanding spaced relation thereto, with the moveable member positioned substantially within the opening in the closed position.

According to one aspect of the invention, the hinge mechanism itself comprises a fixed hinge component and a moveable hinge component, with the fixed hinge component comprising a base portion, a longitudinally extending pin portion and a support arm extending between the base and hinge portions in connecting relation therewith. The base portion is adapted to be mountable upon the fixed frame member. The pin portion has a substantially cylindrical outer surface, and is terminally positioned on the support arm. A portion of the substantially cylindrical outer surface defines a first bearing surface. The first bearing surface is directed generally toward the opening, when the base portion is operatively mounted upon the fixed frame member, such that the longitudinal axis of the pin portion is coincident with the pivot axis. The moveable hinge component has a pivoting portion and a swinging portion, with the swinging portion being adapted for attachment to the moveable member. The pivoting portion has a concave inner second bearing surface concentric with the first bearing surface, which second bearing surface is operatively mounted about the first bearing surface, so as to provide for pivotal movement of the movable member as first mentioned.

According to another aspect of the invention, the support arm has a main body portion radially extending outwardly from the base portion in operatively overlying relation to the pin portion and a web portion directed radially inwardly from the main body portion toward the longitudinal axis of the pin portion so as to connect with said pin portion as aforesaid.

According to another aspect of the invention, the main body portion of the support arm has a generally convex outer surface shaped and dimensioned to act as a drip-edge when the linear edge of the opening is a horizontal linear edge and the fixed hinge component is operatively mounted upon the fixed frame member with the longitudinal axis of the pin portion being oriented substantially parallel to said horizontal linear edge.

According to yet another aspect of the invention, the hinge mechanism additionally comprises an arresting means, which arresting means itself comprise a first longitudinally extending shoulder projecting from the moveable hinge component and a second longitudinally extending shoulder projecting from the fixed hinge component. The first and second shoulders are arranged such that, upon pivotal movement of the moveable hinge component to the open position, the first shoulder impinges upon the second shoulder to arrest further opening rotation.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

DETAILED DESCRIPTION OF A PREFERRED EMBODIMENT

Figure 1:
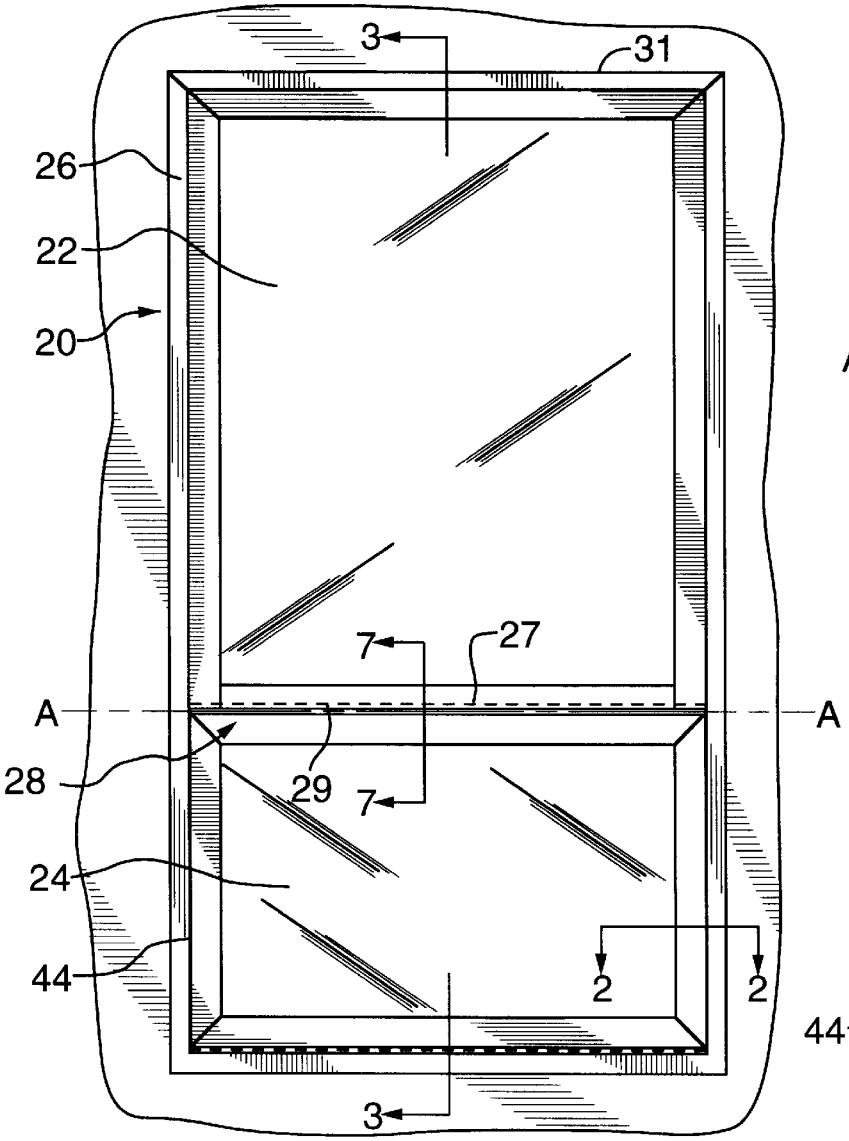
FIG. 1 is a front elevation of a duplex window assembly having an inoperable upper window and an operable lower window retained within a fixed window frame, which assembly includes the hinge mechanism of the present invention according to a preferred embodiment, with the operable lower window shown in its closed position.

In FIG. 1 there is shown a duplex window assembly 20 comprising an inoperable upper window 22 and an operable lower window 24 retained within a fixed frame member 26, the inoperable upper window 22 and operable lower window 24 being separated by a horizontal transom 28, which transom 28 forms part of the fixed frame member 26.

The fixed frame member 26 can be inserted into a window opening 31, thereafter to be leveled with known leveling means, such as shims (not shown) and rigidly attached through known means of attachment, such as screws (not shown) to said window opening 31. The duplex window assembly 20 is constructed, in part, from extruded components, the extruded material preferably being resistant to corrosion and decomposition, and being relatively strong for its weight, such as aluminum metal.

Figure 3:
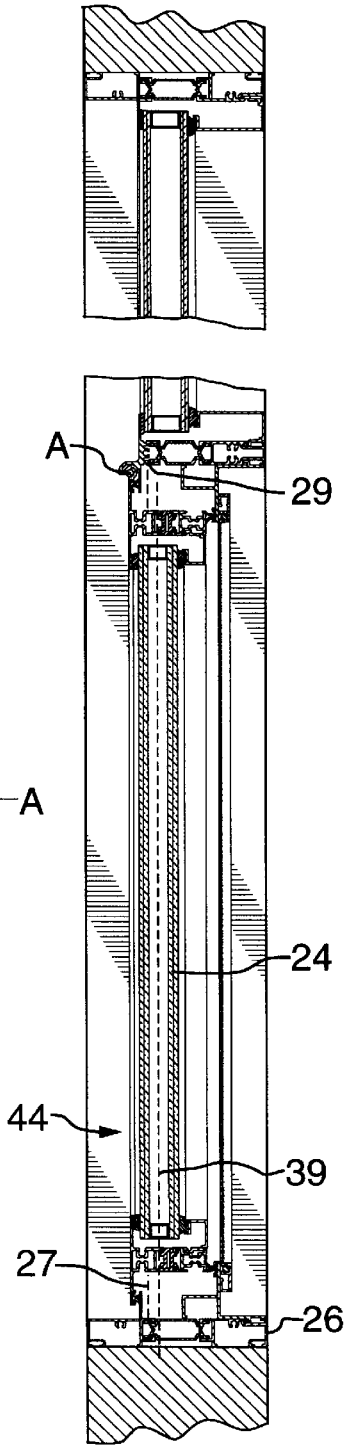
FIG. 3 is a sectional view taken along the sight line 3—3 of FIG. 1, detailing the construction of the upper and lower windows and the window frame, and showing the lower window in its closed position.
Figure 2:
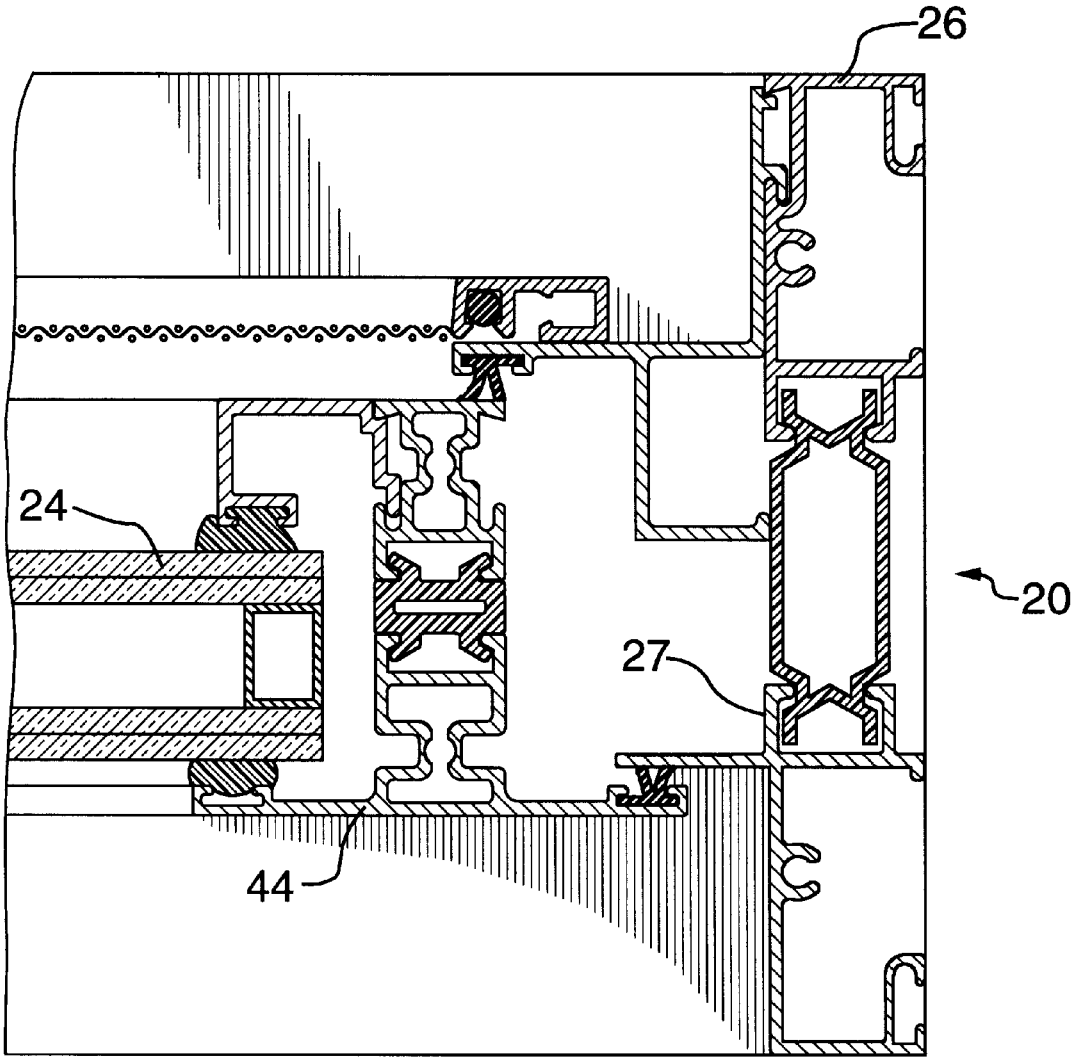
FIG. 2 is a sectional view taken along the sight line 2—2 of FIG. 1, detailing the construction of the lower window and the window frame.
Figure 4:
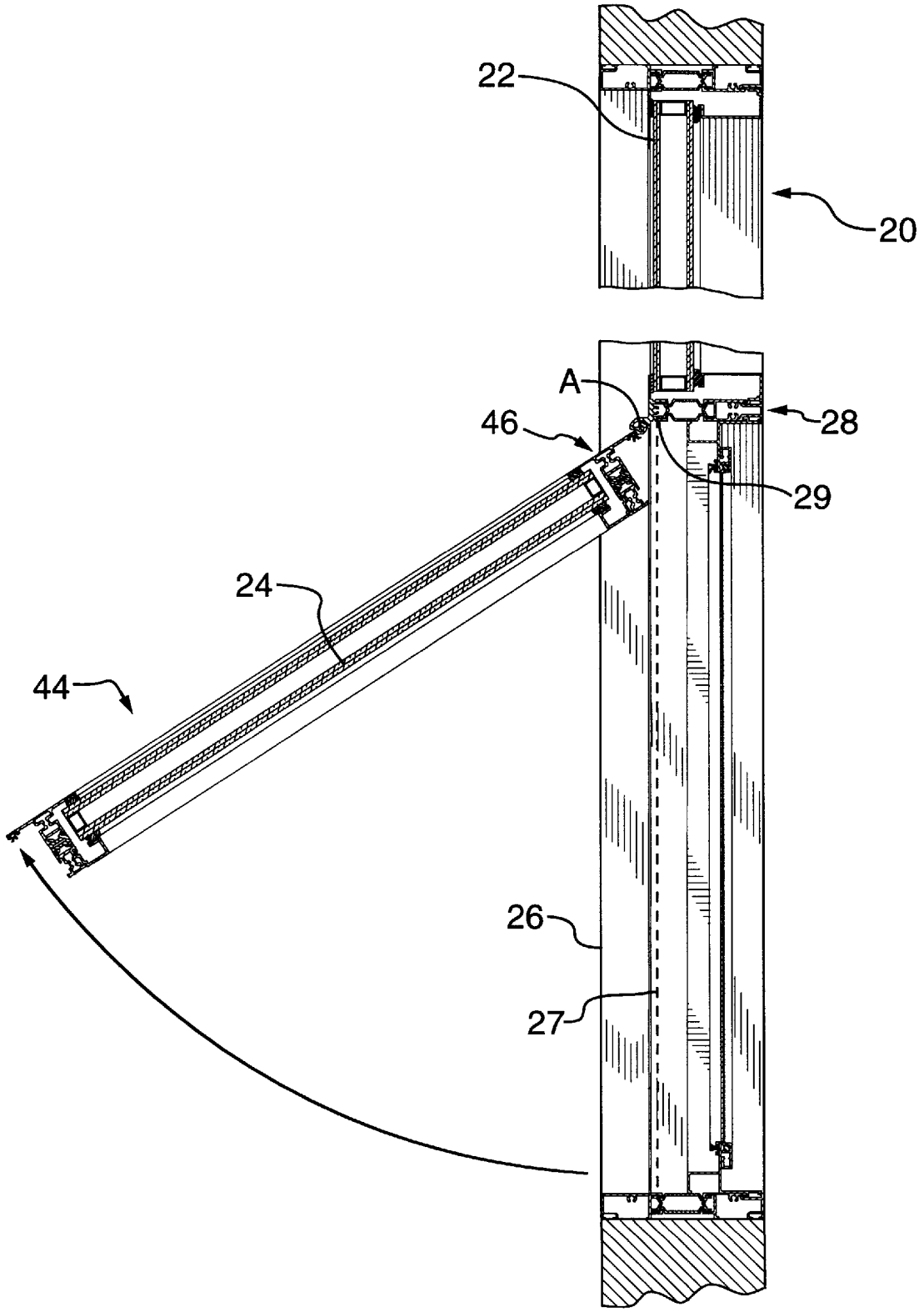
FIG. 4 is a sectional view similar to FIG. 3, but showing the lower window in its open position.

The fixed frame member 26 defines a substantially rectangular vent opening 27. The transom 28 defines an upper horizontal linear edge 29 of the vent opening 27. As best seen in FIG. 4, operable lower window 24 is retained within a moveable member 44, which is a window sash in the preferred embodiment. FIG. 3 shows the duplex window assembly 20 in its closed position, wherein the moveable member 44 is positioned substantially within the vent opening 27. FIG. 4 shows the duplex window assembly in its open position. It can be seen in FIGS. 3 and 4 that the moveable member 44 can pivot between its open position and closed position about a pivot axis A aligned parallel and adjacent to linear edge 29 and positioned in offstanding spaced relation thereto.

The subject matter of this invention is a hinge mechanism 37, shown generally in FIG. 6, more fully described in the following paragraphs, which operatively attaches the moveable member 44 to the fixed frame member 26 and which allows for said pivotal movement of the moveable member 44 with respect to the fixed frame member 26 about pivot axis A.

The hinge mechanism 37 comprises a fixed hinge component 32 and a moveable hinge component 50.

Figure 5:
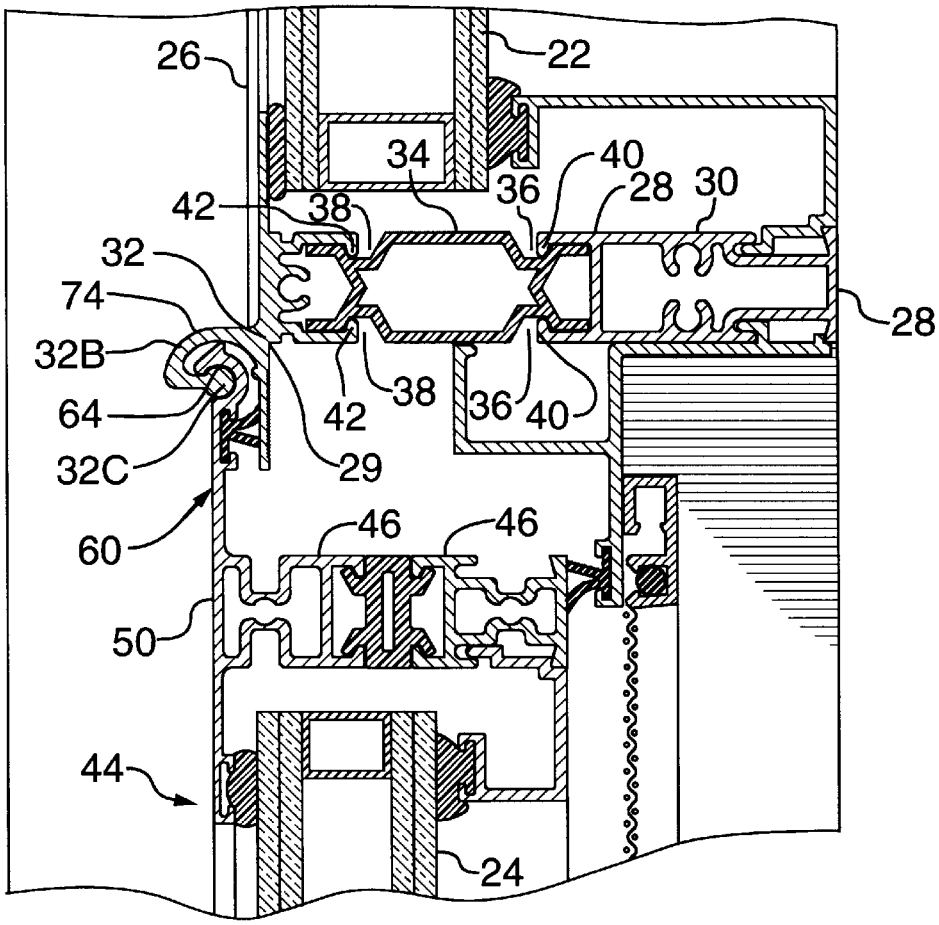
FIG. 5 is an enlarged fragmentary section taken from FIG. 3.
Figure 5A:
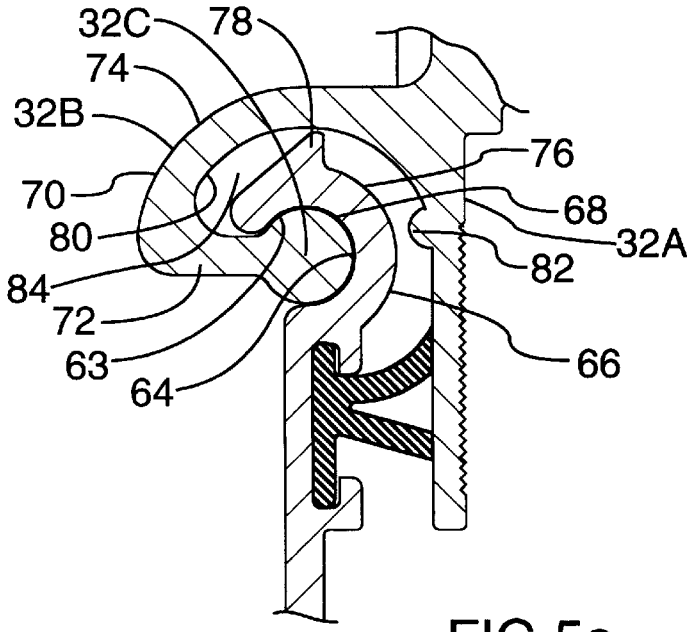
FIG. 5*a* is an enlarged fragmentary section taken from FIG. 5.

As shown in FIG. 5, the fixed hinge component 32 comprises a base portion 32A, a longitudinally extending pin portion 32C and a support 32B arm extending between said portions in connecting relation therewith. As more fully described in the following paragraphs, the base portion 32A is adapted such that it rigidly interlocks with and is thereby mounted upon the fixed frame member 26 in the preferred embodiment. However, in an alternative embodiment, not shown, the base portion could, of course, be mounted through known mounting means, such as screws, etc., upon the fixed frame member. As seen in FIGS. 5 and 5*a*, the pin portion 32C has a substantially cylindrical outer surface 63 and is terminally positioned on the support arm 32B, with a portion of said substantially cylindrical outer surface 63 defining a first bearing surface 64 being directed generally toward the vent opening 27 defined by the fixed frame member 26. The longitudinal axis of the pin portion 35 is coincident with the pivot axis A.

The moveable hinge component 50 has a pivoting portion 66 and a swinging portion 60. As more fully described in the following paragraphs, the swinging portion 60 of the moveable hinge component 50 is adapted such that it rigidly interlocks with and is thereby attached to the moveable member 44 in the preferred embodiment. However, in an alternative embodiment, not shown, the swinging portion of the moveable hinge component could, of course, be attached through known attachment means, such as screws, etc., to the moveable member. The pivoting portion 66 has a concave inner second bearing surface 68 which is concentric with the first bearing surface 64 and which is operatively mounted about said first bearing surface 64 so as to provide for said pivotal movement of the moveable member 44.

It can be seen that a feature of the hinge mechanism 37 is that the support arm 32B has a main body portion 70 extending outwardly from the base portion 32A in operatively overlying relation to the pin portion 32C and a web portion 72 directed radially inwardly from the main body portion 70 toward the longitudinal axis 35 of the pin portion 32C so as to connect with said pin portion 32C as aforesaid, and, in the preferred embodiment, the main body portion 70 of the support arm 32B has a generally convex outer surface 74 shaped and dimensioned to act as a drip-edge.

In the preferred embodiment, the web portion 72 is directed radially inwardly as aforesaid in substantially normal relation to a lateral plane 39 notionally defined by the moveable member 44 in the closed position. This notional lateral plane 39 is shown in dotted outline in FIG. 3. However, in an alternative embodiment, not shown, the web portion could be directed radially inwardly and upwardly from the main body portion to the pin portion, thereby enabling free rotation of the moveable hinge component to both the inner and outer sides of the fixed frame member.

Figure 6:
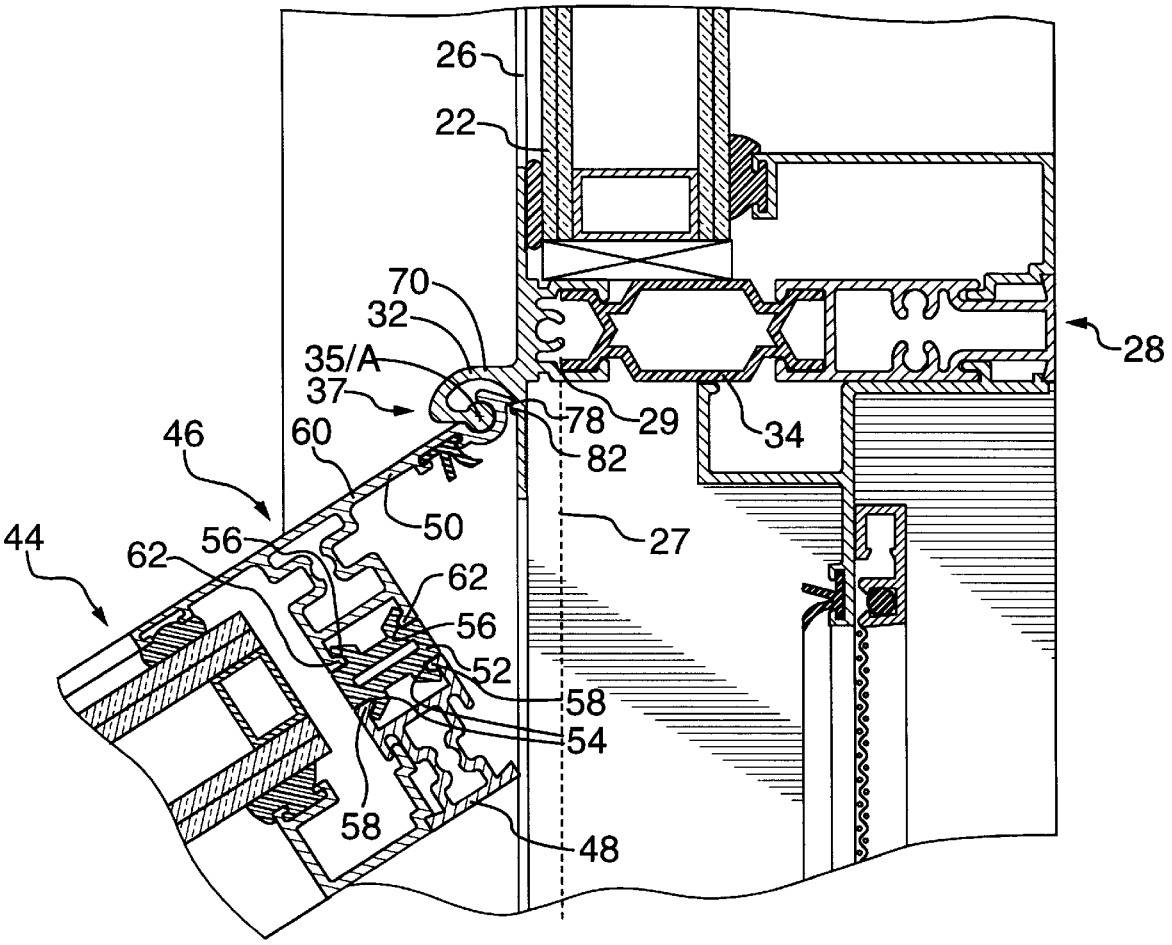
FIG. 6 is an enlarged fragmentary section taken from FIG. 4.
Figure 7:
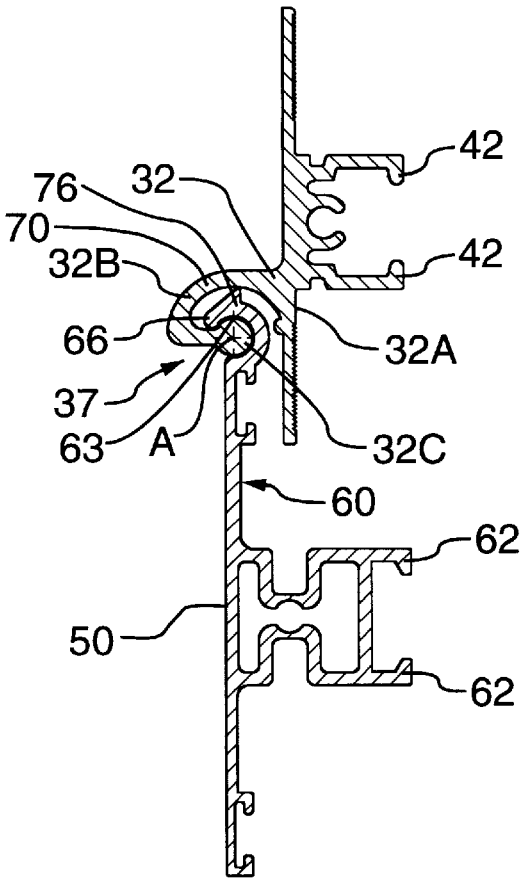
FIG. 7 is a partial sectional view taken along the sight line 7—7 of FIG. 1, illustrating the hinge mechanism in its closed position.
Figure 8:
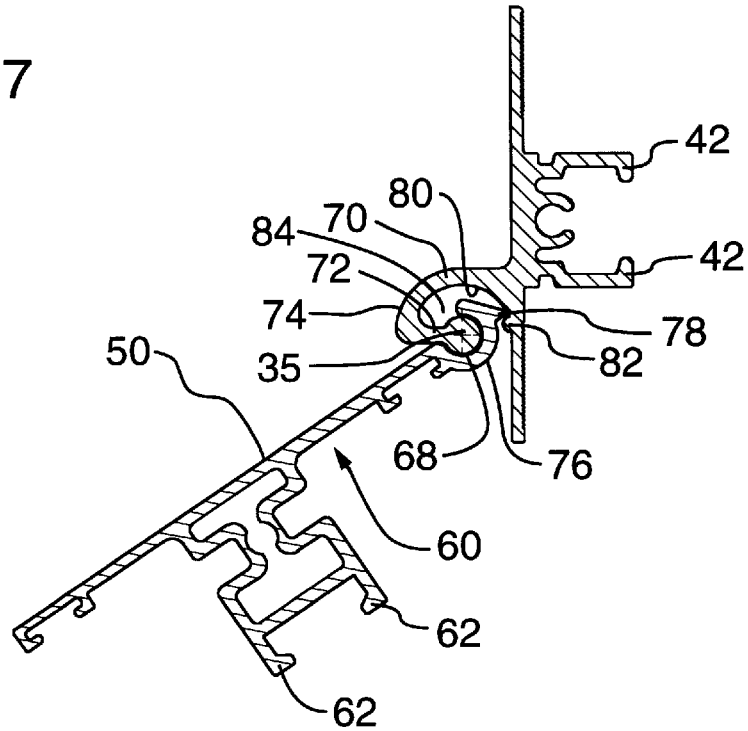
FIG. 8 is a partial sectional view similar to FIG. 7, illustrating the hinge mechanism in its open position.
Figure 9:
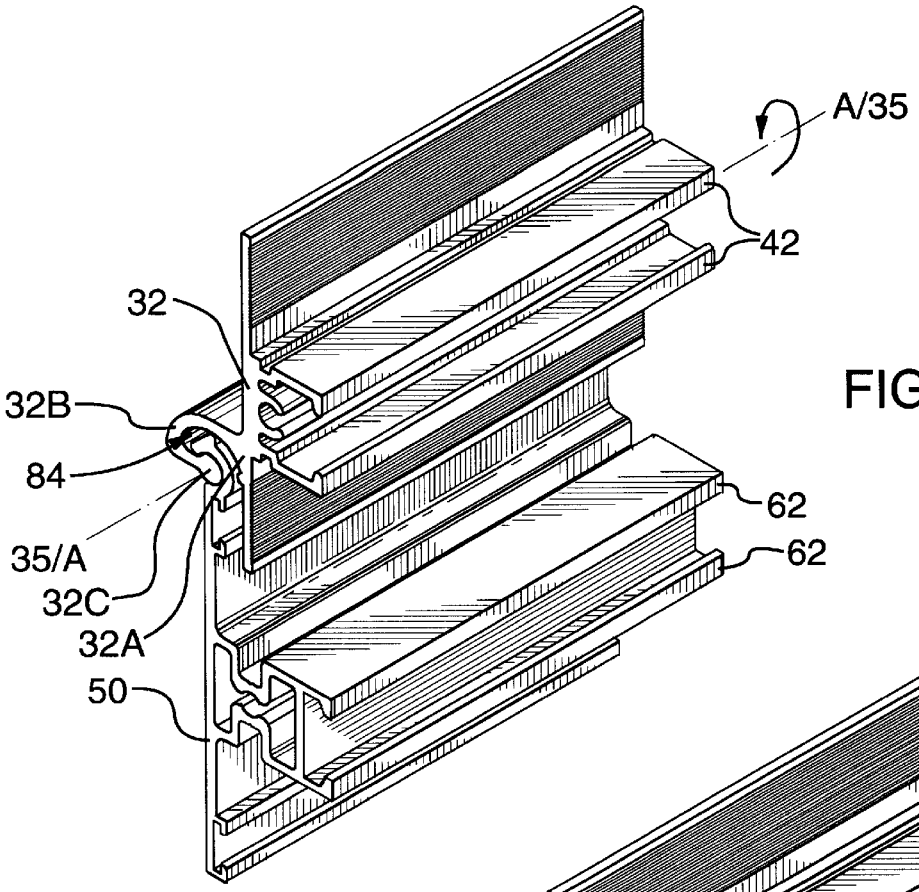
FIG. 9 is a perspective view of the hinge mechanism, similar to FIG. 7.
Figure 10:
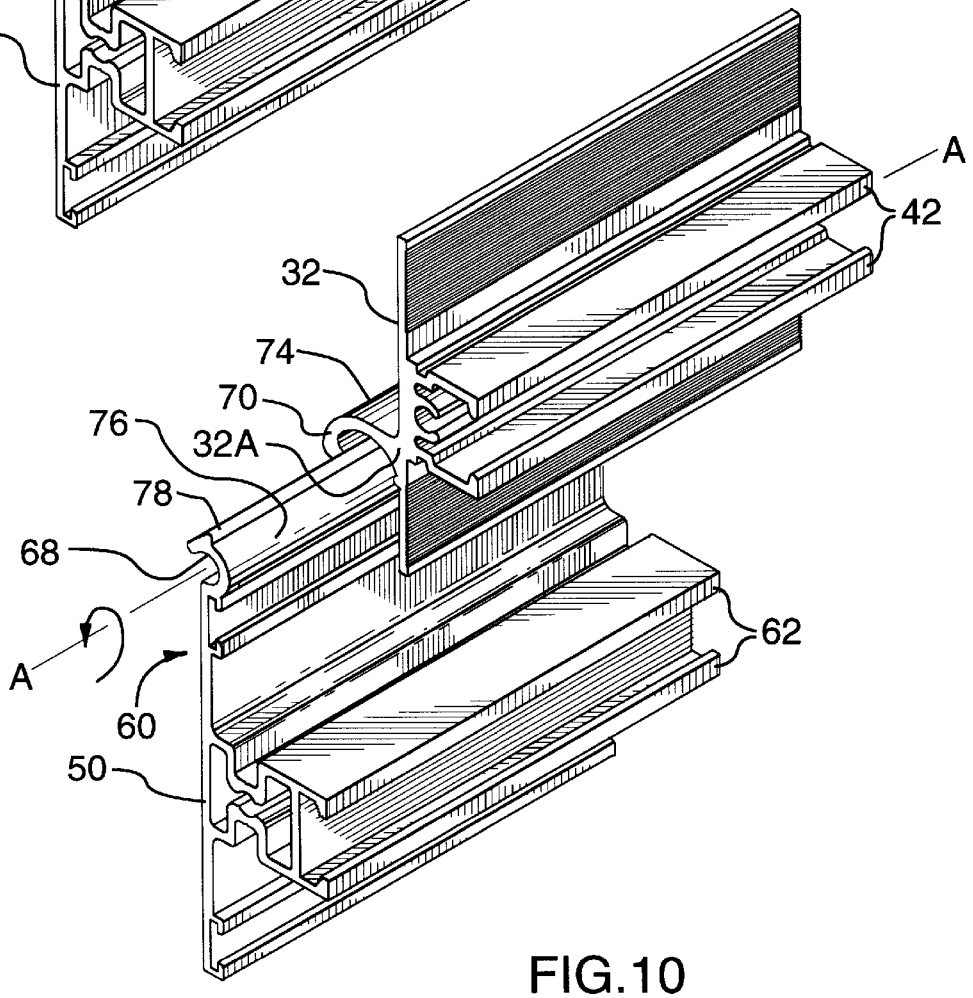
FIG. 10 is a perspective view of the hinge mechanism, similar to FIG. 9, but with the fixed hinge component laterally offset from the moveable hinge component.

A further feature of the hinge mechanism is an arresting means (see especially FIGS. 5 through 9) comprising a first longitudinally extending shoulder 78 projecting from the moveable hinge component 50, and a second longitudinally extending shoulder 82 projecting from the fixed hinge component 32, wherein the first shoulder 78 and second shoulder 82 are arranged such that, upon pivotal movement of the moveable hinge component 50 to the open position (as best seen in FIGS. 6 and 8), the first shoulder 78 impinges upon the second shoulder 82 to arrest further opening rotation. In the preferred embodiment shown, the moveable hinge component 50 and first shoulder 78 are integrally formed through a process of extrusion, and the fixed hinge component 32 and the second shoulder 82 are similarly integrally formed.

In the preferred embodiment shown, the pivoting portion 66 of the moveable hinge component 50 has a convex outer surface 76 substantially coaxial to the inner concave second bearing surface 68, and the first shoulder 78 projects radially from said convex outer surface 76.

As well, in the preferred embodiment, the main body portion 70 of the support arm 32B presents a generally concave interior surface 80, which interior surface 80 defines a semi-circular channel 84 shown on FIG. 8 operatively coaxial with the longitudinal axis of the pin portion 32C and circumferentially extending between the web portion 72 and the base portion 32A, with the second shoulder 82 projecting radially from said interior surface 80.

As referred to earlier, in the preferred embodiment, the base portion 32A of the fixed hinge component 32 is adapted such that it rigidly interlocks with and is thereby mounted upon the fixed frame member 26, and the swinging portion 60 of the moveable hinge component 50 is adapted such that it rigidly interlocks with and is thereby attached to the moveable member 44.

As best seen in FIG. 5, the transom 28 is comprised of an inner transom extrusion 30 and a first mounting means, comprising a transom thermal barrier 34. The transom thermal barrier 34, which defines the linear edge 29 of the vent opening 27, is constructed of material resistant to corrosion, substantially impermeable to moisture and having low thermal conductivity, such as plastic, and has inner transom grooves 36 and outer transom grooves 38. The inner transom extrusion 30 has inner transom lips 40 which rigidly interconnect with the inner transom grooves 36. The base portion 32A of the fixed hinge component 32 similarly is mounted upon the transom 28 by outer transom lips 42 which rigidly interconnect with the outer transom grooves 38.

Similarly, as most clearly seen in FIG. 4, the lower window 24 is retained within moveable member 44 having a top rail 46. As best seen in FIG. 6, the top rail 46 is comprised of an inner sash extrusion 48 and a first attachment means, comprising a sash thermal barrier 52. The sash thermal barrier 52 is constructed of similar material to the transom thermal barrier 34, preferably plastic, and has inner sash grooves 54 and outer sash grooves 56. The inner sash extrusion 48 has inner sash lips 58 which rigidly interconnect with the inner sash grooves 54. The swinging portion 60 of the moveable hinge component 50 is attached to the top rail 46 by outer sash lips 62 which rigidly interconnect with the outer sash grooves 56.

While but a single specific embodiment of the present invention is herein shown and described, it will be understood that various changes in size and shape of parts may be made without departing from the spirit of invention.

For example, in a first alternative embodiment of the present invention, not shown, it is contemplated that the pin portion could be positioned generally in the plane of the frame, beneath the transom, as opposed to its position outside the frame as described in the preferred embodiment. This could be accomplished by inwardly offsetting the pin portion in a direction substantially normal to the lateral plane defined by the moveable member in the closed position.

I claim:

1. In combination, a hinge mechanism for operative pivotal attachment of a moveable member to a fixed frame member and a fixed frame member defining a linear edge of an opening, for pivotal movement of the moveable member relative to the fixed frame member between an open position and a closed position about a pivot axis aligned parallel to and adjacent to said linear edge and positioned in offstanding spaced relation to the linear edge, wherein the moveable member is positioned substantially within the opening in the closed position, said hinge mechanism comprising:

a fixed hinge component and a moveable hinge component;

the fixed hinge component defining a generally concave interior surface and comprising a base portion, a longitudinally extending pin portion and a support arm extending between said base portion and said pin portion in connecting relation therewith, with the base portion being adapted to be mountable upon the fixed frame member and the pin portion having a substantially cylindrical outer surface and being terminally positioned on the support arm, a portion of said substantially cylindrical outer surface defining a first bearing surface, wherein the first bearing surface is directed generally toward the opening when the base portion is operatively mounted upon the fixed frame member, such that the longitudinal axis of the pin portion is coincident with said pivot axis, the support arm having a main body portion extending outwardly from the base portion in operatively overlying relation to the pin portion and a web portion directed radially inwardly from the main body portion toward the longitudinal axis of the pin portion in substantially normal relation to a lateral plane defined by the movable member in the closed position so as to connect with said pin portion as aforesaid, the main body portion of the support arm having a generally convex outer surface shaped and dimensioned to act as a drip-edge when the linear edge of the opening is a horizontal linear edge and the fixed hinge component is operatively mounted upon the fixed frame member with the longitudinal axis of the pin portion being oriented substantially parallel to said horizontal linear edge, and wherein the concave interior surface of the fixed hinge component defines a substantially semi-circular channel operatively co-axial with the longitudinal axis of the pin portion and circumferentially extending between the web portion and the base portion;

the moveable hinge component having a pivoting portion and a swinging portion, the swinging portion being adapted for attachment to the moveable member, the pivoting portion having a concave inner second bearing surface concentric with the first bearing surface and being operatively mounted about said first bearing surface so as to provide for said pivotal movement of the moveable member, the pivoting portion further having a convex outer surface substantially coaxial to the inner concave second bearing surface; and an arresting means comprising:

a first longitudinally extending shoulder projecting radially from the convex outer surface of the pivoting portion of the moveable hinge component; and a second longitudinally extending shoulder projecting radially from the concave interior surface of the fixed hinge component, said first and second shoulders being arranged such that, upon pivotal movement of the moveable hinge component to the open position, the first shoulder impinges upon the second shoulder to arrest further opening rotation.

2. The combination according to claim 1, wherein the moveable hinge component and the first shoulder are integrally formed through a process of extrusion.

3. The combination according to claim 2, wherein the fixed hinge component and the second shoulder are integrally formed through a process of extrusion.

4. The combination according to claim 3, wherein the moveable member is a window sash having a top rail.

5. The combination according to claim 4, wherein the top rail is comprised of at least one extruded sash component and the moveable hinge component is attached to at least one said extruded sash component by a first attachment means having low thermal conductivity, low permeability to moisture and being resistant to corrosion.

6. The combination according to claim 5, wherein the extruded components are comprised of metal.

7. The combination according to claim 6, wherein the extruded components are comprised of aluminum metal.

8. The combination according to claim 3, wherein the fixed frame member is a window frame having a transom.

9. The combination according to claim 8, wherein the transom is comprised of at least one extruded frame component and the fixed hinge component is mounted upon at least one said extruded frame component by a first mounting means which defines said linear edge, said first mounting means having low thermal conductivity, low permeability to moisture and being resistant to corrosion.

10. The combination according to claim 9, wherein the extruded components are comprised of metal.

11. The combination according to claim 10, wherein the extruded components are comprised of aluminum metal.

* * * * *